US006071429A

United States Patent [19]

Wofford et al.

[11] Patent Number: 6,071,429

[45] Date of Patent: Jun. 6, 2000

[54] VISCOSITY-STABILIZED AMIDE COMPOSITION, METHODS OF PREPARING AND USING SAME

[75] Inventors: James A. Wofford, Fountain Inn, S.C.; Steve C. James, Gastonia, N.C.

[73] Assignee: Henkel Corporation, Gulph Mills, Pa.

[21] Appl. No.: 07/949,676

[22] Filed: Sep. 21, 1992

[51] Int. Cl.[7] ..... D06M 10/00; C11D 7/32; C11D 7/26

[52] U.S. Cl. ..... 252/8.63; 510/295; 510/438; 510/470; 510/501; 510/515

[58] Field of Search ..... 252/8.6, 8.75, 252/8.8, 174.17, 525

[56] References Cited

U.S. PATENT DOCUMENTS

| | | | |
|---|---|---|---|
| 3,219,656 | 11/1965 | Boettner | 260/210 |
| 3,547,828 | 12/1970 | Mansfield et al. | 252/351 |
| 3,598,865 | 8/1971 | Lew | 260/210 |
| 3,707,535 | 12/1972 | Lew | 260/210 |
| 3,772,269 | 11/1973 | Lew | 260/210 |
| 3,839,318 | 10/1974 | Mansfield | 260/210 |
| 4,154,706 | 5/1979 | Kenkare et al. | 252/547 |
| 4,196,201 | 4/1980 | Boelle et al. | 424/180 |
| 4,304,679 | 12/1981 | Hooper et al. | 252/106 |
| 4,323,468 | 4/1982 | Grollier et al. | 252/174.17 |
| 4,349,669 | 9/1982 | Klahr et al. | 536/127 |
| 4,393,203 | 7/1983 | Mao et al. | 536/124 |
| 4,396,520 | 8/1983 | Payne et al. | 252/89.1 |
| 4,472,170 | 9/1984 | Hellyer | 44/51 |
| 4,483,779 | 11/1984 | Llenado et al. | 252/135 |
| 4,493,773 | 1/1985 | Cook et al. | 252/8.8 |
| 4,510,306 | 4/1985 | Langdon | 536/127 |
| 4,536,319 | 8/1985 | Payne | 252/174.17 |
| 4,565,647 | 1/1986 | Llenado | 252/354 |
| 4,597,770 | 7/1986 | Forand et al. | 44/51 |
| 4,599,188 | 7/1986 | Llenado | 252/174.17 |
| 4,606,850 | 8/1986 | Malik | 252/528 |
| 4,627,931 | 12/1986 | Malik | 252/153 |
| 4,657,999 | 4/1987 | Hoefer et al. | 526/200 |
| 4,663,069 | 5/1987 | Llenado | 252/117 |
| 4,668,422 | 5/1987 | Malik et al. | 252/174.17 |
| 4,678,595 | 7/1987 | Malik et al. | 252/174.17 |
| 4,704,453 | 11/1987 | Lorenz et al. | 536/18.6 |
| 4,705,665 | 11/1987 | Malik | 422/12 |
| 4,713,447 | 12/1987 | Letton | 536/18.6 |
| 4,732,696 | 3/1988 | Urfer | 252/174.17 |
| 4,732,704 | 3/1988 | Biermann et al. | 252/548 |
| 4,748,158 | 5/1988 | Biermann et al. | 514/25 |
| 4,767,559 | 8/1988 | Kruse et al. | 252/106 |
| 4,780,234 | 10/1988 | Malik et al. | 252/135 |
| 4,795,675 | 1/1989 | Dunn, Jr. et al. | 428/260 |
| 4,913,828 | 4/1990 | Caswell et al. | 252/88 |
| 4,915,854 | 4/1990 | Mao et al. | 252/8.8 |
| 4,987,225 | 1/1991 | Pickens | 536/124 |
| 5,073,274 | 12/1991 | Caswell | 252/8.6 |

FOREIGN PATENT DOCUMENTS

| | | |
|---|---|---|
| 0092355 | 10/1983 | European Pat. Off. . |
| 0096917 | 12/1983 | European Pat. Off. . |
| 0132043 | 1/1985 | European Pat. Off. . |
| 63-288821 | 11/1988 | Japan . |

OTHER PUBLICATIONS

"Preparation and Properties of Pure Alkyl Glucosides, Maltosides and Maltotriosides", JAOCS, vol. 61, No. 10, pp. 1651–1655, Oct. 1984; "Physical and Functional Properties of Some Higher Alkyl Polyglucosides", JAOCS, vol. 47, pp. 162–167, 1970.

*Primary Examiner*—Yogendra Gupta
*Assistant Examiner*—Gregory R. Delcotto
*Attorney, Agent, or Firm*—Ernest G. Szoke; Wayne C. Jaeschke; Patrick J. Span

[57] ABSTRACT

Amide compositions useful for softening textile materials, such as fabrics. A concentrate composed of the amide softener and an alkylpolyglycoside is diluted to provide a softening solution of low viscosity stable over extended periods, which on application to a fabric provide improved hand (softeners) and scorch resistance.

13 Claims, No Drawings

VISCOSITY-STABILIZED AMIDE COMPOSITION, METHODS OF PREPARING AND USING SAME

BACKGROUND OF THE INVENTION

1. Field of the Invention

This invention relates to amide compositions, particularly long chain amide compositions, useful for softening textile materials, including fabrics, yarns and fibers. In particular, the invention relates to the composition of alkyl (about 8 to about 22 carbon atoms) amides and alkylpolyglycosides, concentrates of which are dilutable to aqueous solutions employed for softening textile materials, particularly fabrics, which solutions are viscosity-stable over long periods and which provide improved softening properties.

2. Discussion of Related Background Art

A most important class of textile finishing agents is the softeners, whose function is to modify the surface feel, called "hand". The fabric is made soft or pleasant to the touch and also possesses aesthetic draping qualities. Softeners may be used as finishes in themselves or together with other finishing agents, to overcome the inherent harshening characteristic of the other finishes.

A "pure" finish refers to application of the softener, by itself, to the textile material, generally a fabric, but may include the fiber of a yarn itself, to be later formed into fabric. In a pure finish no other chemical is generally present in the bath except, possibly a wetting agent if the fabric is dry. The total effect on the fabric, other than softening, may be improved sewability, improved absorbency or a decrease in the fiber to fiber or fiber to metal friction.

As a finish bath component, the softener performs several functions. In resin baths applied to materials, such as polyester-cotton knits or woven goods, it may act to plasticize the resin and reduce the harshness of the hand. It frequently will add lubricity to the fiber surface and improve sewability by minimizing heat buildup of the sewing needle, thereby eliminating needle cutting. The improved lubricity will also help minimize abrasion and improve tear strength.

Since softeners are usually the last chemical applied to yarn or fabric, commercial softeners must meet certain requirements. Softeners must be (a) non-yellowing (b) odor-free (c) compatible with other finish bath components (d) have no negative effect on dye shade (e) non-volatile and non-smoking (f) non-scorching, and (g) stable.

A wide variety of chemical structures have been used in the past to serve as softening agents, almost all of them being based on fatty acids having chain lengths of about 8 to 22 carbon atoms. Among the preferred softeners are the fatty acid amides. Such amide softening agents are supplied commercially in concentrate form for dilution by the customer for formulation with other finish bath components. While the amide softening agents provide good softening properties and generally meet the requirements for softening agents, it has generally been necessary to add emulsifiers or diluents such as glycols and ethoxylated phenols, thereto to provide storage stable compositions, either as concentrates, or in a diluted form for use. In storage for any long period of time, amide softeners tend to gel, or increase or vary in viscosity when stored, or in use, over an extended period of time. Changes in viscosity of the finish bath can effect the deposition of the softeners to the fabric, resulting in uneven distribution of the softener to the fabric. In the past, emulsifiers and diluents employed, while lowering viscosity somewhat of the dilute solution to be applied to the fabric, tended to increase in viscosity, or vary in viscosity, over periods of time in which they were to be used or stored for use. For ease in application, as well as thorough application to the fabric, the viscosity should be relatively low and uniform, so that the solution can be easily applied with uniform application to the fabric without undue or non-uniform build up.

While not dealing directly with the softening of textiles, U.S. Pat. No. 4,795,675 relates to a treatment of fabrics to impart improved heat transfer printability thereto, employing alkyl glucosides in which the alkyl groups contain from 2–8, preferably 2–6 carbon atoms, with butyl glucoside being preferred. Other auxiliary treating agents may be employed along with glucoside, including up to about 5 weight percent of a conventional fabric softening ingredient, e.g. fatty acid amide fabric softener ingredients, (column 5, lines 52–55). In Example 2 of the patent an aqueous solution containing 7.5% of a monoglucoside, methyl glucoside, which also contains 3% of a fatty acid amide softener, is employed.

DETAILED DESCRIPTION OF THE INVENTION

Other than in the operating examples, or when otherwise indicated, all numbers expressing quantities, or reaction conditions, used herein are to be understood as modified in all instances by the term "about".

It has now been discovered that alkylpolyglycosides, when added to amide softening agents used for textile softening, will provide concentrates, and diluted solutions usually employed for application to textile materials, which are viscosity stable and of low viscosity, without the necessity for adding emulsifiers or diluents. It was found that the alkylpolyglycosides act to reduce the viscosity and to maintain the viscosity at a stable, uniform level for extended periods of time. Thus, the alkylpolyglycosides act to improve the solubility of the amide softeners without the need for added emulsifier or diluent.

It is accordingly an object of the invention to provide a concentrate consisting essentially of an amide textile softening agent, an alkylpolyglycoside and water, as well as dilute solution thereof, useful for application to textile materials. It is also an object of the invention to provide a method of preparing such concentrates, and dilute solutions thereof, and a method for treating textile materials with such solutions to provide a soft feel or hand to the textile material, while maintaining or improving upon the other properties required of a softening agent.

Accordingly, one aspect of the invention is to provide a concentrate of a long chain amide and an alkylpolyglycoside, consisting essentially of the amide in the major amount, the alkylpolyglycoside in a minor amount and water. The amide concentration therein will be in excess of 50% by weight and preferably in excess of about 60% by weight, to about 90% by weight with about 70–80% being most preferred. The amount of alkylpolyglycoside in the concentrate will range from about 10 to about 30% by weight, more desirably 10 to about 25%, with about 10% to about 20% by weight being most preferred. The amount of water in the concentrate, as the term is used herein, will not exceed about 25% by weight and typically will be about 10 to about 20%, with about 10 to about 15% being most preferred. This concentrate forms a softener base, which is significantly less viscous upon dilution for use as a softener for textile materials and which diluted product is storage stable for extended periods without fluctuation or increased viscosity. The concentrate results in low freight and shipping costs to the customer because the amount of water is small in relation to the high concentration of the amide softener and the alkylpolyglycoside. The customer can generally formulate the concentrate by dilution for the particular softening application and addition of other adjuvants or auxiliary agents usually employed for the particular textile to which the softener is to be applied.

In use as a softening agent, the concentrate will be diluted to a solids concentration (amide softener and alkylpolyglycoside) to a level of about 1 to 25% by weight, preferably about 5 to about 20% by weight. Such solutions at 18.5% concentration of amide plus alkylpolyglycoside will have a viscosity of less than about 50,000 centipoises, i.e. about 30,000 centipoises (cps) at 25° C. measured by a Brookfield Model DVII Viscosimeter. In contrast thereto, the same amide softener formulated with a glycol, such as hexylene glycol and or an ethoxylated alkylphenol, such as nonylphenol containing 30–40 ethoxy units, will have a viscosity at 25° C. of about 95,000 cps. Further, upon storage the viscosity of the amide plus alkylpolyglycoside softener solution will remain substantially constant over long periods of time, i,e,, 6 weeks. In contrast, solutions containing other emulsifiers or diluents, such as the hexylene glycol and ethoxylated nonylphenol will illustrate a viscosity increase up to about 160,000 cps at 6 weeks. Thus, the aqueous solutions of the concentrate of the present invention not only provide a significant decrease in viscosity initially, but maintain much lessened viscosity over prolonged periods of time, a significant and unexpected advantage to the formulation customer and user for softening textile materials.

If desired, to further decrease the initial viscosity of the aqueous solution, it was found further that long chain ethoxylated alkyl amines may be employed. These amines will have alkyl chains containing from about 8 to about 22 carbon atoms and contain from about 4 to about 50 ethoxy units, with about 15 to 20 units being preferred. The ethoxylated amines may be incorporated into the concentrate, in an amount of up to 10% by weight of the total concentrate, preferably in an amount of about 5 to 6% being preferred.

The amide based softener compounds, preferred for the softening of textile materials are those containing long alkyl chains such as typical fatty acid chains containing from about 8 to about 22 carbon atoms. While the term "textile material" is primarily intended to apply to fabric substrates, e.g. woven or knitted material, it is to be understood that the softener agents of the present invention may be applied as well to yarns or individual fibers from which the fabrics are prepared. The fatty acid amide softeners are preferably those prepared from fatty acid containing about 10 to about 18 carbon atoms, with the longer chains being most preferred. Thus, the coco fatty acids (high lauric acid) containing predominantly the 12, 14 and 16 carbon acids and hydrogenated tallow type, containing predominantly palmitic (16) stearic (18) and oleic (18) acids with some myristic (14) are especially preferred. The fatty acid amides are prepared by reaction of the fatty acids with various nitrogen containing compounds. The preferred nitrogen compounds are those containing hydroxyl as well as amine groups such as the alkanol amines, in which the alkanol group contains from about 2 to about 6 carbon atoms, preferably 2–4 carbon atoms. The most preferred are amines such as diethanolamine which will provide amides such as hydrogenated tallow diethanol amide, often referred to as stearic-oleic diethanol amide. While the alkanol amines preferred contain only one amine group, other long chain amide compounds may contain additional nitrogen atoms to form amide groups. Accordingly compounds such as aminoethylethanolamine distearamide are contemplated within the scope of the invention in the term "fatty acid amide" used herein, and will encompass a series of substituted amides of polyamines including, ethylene diamine, diethylene triamine, triethylene tetramine, tetraethylene pentamine and dimethylaminopropylamine, as well as the aminoethylethonalamine noted.

The aliphatic polyglycosides (alkylpolyglycosides) are known compositions and can be prepared by the method disclosed in U.S. Pat. No. 4,713,447, which is incorporated herein by reference. In commonly assigned, U.S. application Ser. No. 07/774,430, filed Oct. 10, 1991, also incorporated herein by reference, there is described a number of U.S. patents and published European patent applications describing the preparation of alkylpolyglycosides and their end-use applications. In general, these describe a method of preparation comprising the reaction of a reducing saccharide, e.g., an aldose of ketose saccharide, or source thereof, with a long chain (8–18 carbons) alcohols in the presence of an acid catalyst to form a glycoside, commonly referred to as an alkyl glycoside or alkylpolyglycoside. After removal of the residual unreacted alcohol, the product typically contains the monoglycoside of the long chain alcohol as the predominant glycoside molecular species on a mole percentage basis and the various higher degree of polymerization (DP) long chain alcohol polyglycoside species in progressively decreasing mole percentage amounts or proportions principally from DP2 through DP10 glycosides.

In commercial practice, depending on process economics and the properties of the desired alkylpolyglycoside product, a variety of fatty alcohol reactants may be selected for the reaction. These alcohols include mono alcohols, i.e., those having primarily a single alkyl chain, binary alcohol mixtures, i.e., having primarily two different alkyl chains of different carbon chain lengths, and even ternary mixtures. Binary mixtures of alcohols are available commercially from natural sources as well as synthetic techniques and are employed commercially for the production of the corresponding mixtures of alkylpolyglycosides. Especially important binary alcohol mixtures include the $C_8$–$C_{10}$, $C_{10}$–$C_{12}$, $C_{12}$–$C_{14}$, and $C_{16}$–$C_{18}$ where the alkyl groups are derived from naturally occurring fats and oils. Important ternary mixtures include the $C_{12}$–$C_{14}$–$C_{16}$ or $C_{10}$–$C_{12}$–$C_{14}$ alcohols. The oxo alcohol technology is also employed which provides mixtures containing an odd number of carbon atoms in the alkyl chain, for example an oxo alcohol composed of a mixture of $C_9$, $C_{10}$ and $C_{11}$ alcohols or $C_{12}$ and $C_{13}$ as well. Other synthetic alcohols may be provided by Ziegler Chemistry in which ethylene is added to a triethylaluminum, which is then oxidized to an alkoxide, which is subsequently converted to a mixture of linear alcohols.

The aliphatic polyglycoside surfactants useful in the practice of the present invention are nonionic surfactants of the formula $RO(R_1O)_mG_r$ wherein R, the residue of the alcohol, is an alkyl or alkenyl group having from about 8 to about 22 carbon atoms and preferably from about 10 to 18 carbon atoms. The aliphatic group can be alkyl or alkenyl but is preferably unbranched alkyl. As used in the present invention, the phrase alkylpolyglycoside is intended to encompass both the alkyl and alkenyl polyglycosides. $R_1$ is an alkyl group having 2 or 3 carbon atoms, m is a number from 0 to 10 and preferably 0. When m is 0, the formula for the glycoside product of the reaction of an alcohol and saccharide is then represented by the formula $ROG_r$, where R is as defined above, O is oxygen, G is the residue of a reducing saccharide and r is the average degree of polymerization of the saccharide (DP) resulting from the various mono, di-, tri-, and higher glycoside fractions present in the product and is typically greater than 1, i.e., from about 1.05, to about 3. The monoglycoside fraction would have one saccharide ring, the diglycoside would have 2, the triglycoside would have 3 with the higher glycosides having corresponding more rings, the average of which in the product therefore being typically greater than about 1, generally in the order of about 1.2 to about 2.8, with preferred mixtures at about 1.4 to about 2.5.

The alkylpolyglycoside products represented by the formula above contain a lipophilic group, the R group, and a hydrophilic group, the $OG_r$ group. For detergent surfactant end-use applications, the product preferably has a hydrophilic-lipophilic balance (HLB) of from about 10 to about 16, most preferably about 11 to about 14.

The lipophilic R groups in the alkylpolyglycosides are accordingly derived from alcohols, preferably monohydric, which should contain from about 8 to about 20, preferably about 8 to about 18 carbon atoms, to provide R groups of sufficient length for detergent surfactant use applications. While the preferred R groups are saturated, aliphatic or alkyl groups, there may be present some unsaturated aliphatic hydrocarbon groups. Thus, the preferred groups are derived from the fatty alcohols derived from naturally occurring fat and oils, such as octyl, decyl, dodecyl, tetradecyl, hexadecyl, octadecyl, oleyl and linoleyl, but R groups may be derived from synthetically-produced Ziegler alcohols or oxo alcohols containing 9, 10, 11, 12, 13, 14, or 15 carbon atoms. The alcohols of naturally occurring fatty acids typically contain an even number of carbon atoms and mixtures of alcohols are commercially available such as mixtures of $C_8$ and $C_{10}$, $C_{12}$ and $C_{14}$, and the like. Synthetically-produced alcohols, for example those produced by an oxo process, contain both an even and an odd number of carbon atoms such as the $C_9$, $C_{10}$, $C_{11}$ mixtures of which are also available commercially.

The alkylpolyglycosides may contain a single R group derived from an individual single alcohol, or may be derived from commercially available mixtures of alcohols, either naturally occurring or synthetically produced alcohols, to provide a binary or ternary mixture having 2 or more different alkyl groups. Mixtures of individual single alkylpolyglycosides may be mixed to provide binary or ternary mixtures to result in an average carbon chain length of the alkyl moiety for a desired HLB for a desired end-use application. Similarly mixtures of commercially available binary or ternary alkylpolyglycoside mixtures may be further mixed to reach a predetermined desired average carbon chain length of the alkyl moiety. Thus, in addition to mixtures of a single alkyl group polyglycosides, mixtures of binary components such as $C_8C_{10}$ alkylpolyglycoside may be mixed with another binary mixture component, such as $C_{12}C_{14}$ or a ternary mixture, such as $C_{12}C_{14}C_{16}$ polyglycoside, or $C_9C_{10}C_{11}$ polyglycoside.

The saccharides useful for preparing the aliphatic polyglycoside used in the practice of the present invention, are reducing monosaccharides or materials which can form reducing monosaccharides during the process for preparing the polyglycoside composition. The reducing saccharides include hexoses and pentoses. Typical examples of monosaccharides includes glucose, mannose, galactose, fructose, gulose, talose, altrose, allose, idose, arabinose, xylose, ribose, lyxose and the like, as well as materials which are hydrolyzable to form monosaccharides, such as lower alkyl glycosides (e.g., methyl glycoside, ethyl glycoside, propyl glycoside, butyl glycoside, etc.) and polysaccharides such as starch. More for reasons of its low cost and ready availability, glucose is a preferred saccharide.

While the invention is primarily directed to the treatment of fabrics to provide a soft hand or feel thereto, as indicated earlier, it may also be applied to yarn or fibers from which the fabric may be made. Accordingly the invention is applicable to textile materials generally, and it is understood that "textile materials" as used herein is meant to include yarns, fibers and the like as well as fabrics. The invention finds application in treating fabrics made from synthetic fibers, such as polyester or polyamide fibers, but is especially useful with fabrics containing cellulosic fibers, such as cotton, rayon and cellulosic acetate; wool and other animal fibers and natural fibers such as silk. Fabrics from blends of fiber, such as blends of cellulosic, and/or natural fibers, with polyester and other synthetics, such as polyester/cotton are within the scope of the invention.

The concentrate is prepared by mixing the amide softener agent with the alkylpolyglycoside which acts to solubilize the amide softener in water, in the amounts indicated earlier. With these amounts the ratio of amide softener to alkylpolyglycoside will generally be within the range by weight of about 1.7:1 to about 8:1, and in the preferred composition in the range of about 2.8:1 to about 4:1. For use in treating a fabric to provide the soft hand, the concentrate is diluted with water to the desired concentration level for the particular method of application to the fabric, generally on the order of the concentration discussed earlier. Other auxiliary agents or adjuvants which are to be employed, will be added at this time, if not already added to and present in the concentrate.

The diluted product may be applied to the fabric in a wide variety of application methods, in which the fabric is typically saturated with the diluted softener product. This typically is accomplished by immersion in a bath, spraying, foam technique or padding etc. Typically the application to the fabric is carried out at ambient room temperatures of about 20 to about 25° C. However, lower or higher application temperatures, i.e. about 10° C. or about 40° C. may be employed if convenient or desirable. Typically the aqueous softener solution is applied to provide a wet pickup of about 10% to about 100%, preferably about 50% to about 70%, by weight on a dry fabric.

After application of the softener to the fabric, the fabric is typically dried either at room temperature or at elevated temperatures up to about 150° C. The resulting dried fabric exhibits a soft hand and is scorch resistant. The softened fabric having improved hand will have distributed therein on a dry fabric substrate weight basis from about 0.5 to about 20% by weight of the softener composition.

The following examples serve to illustrate, but not limit, the invention. All parts and percentages are by weight, unless otherwise noticed.

EXAMPLE 1

In this example, a series of amide based softeners were prepared, following a typical commercial formulation employing hexylene glycol and ethoxylated (30 units) nonylphenol as an emulsifier and diluent, compared to the same formulation employing an alkylpolyglycoside as the solubilizer for the amide softener in place of the typical glycol and ethoxylated nonylphenol. In some formulations with the alkylpolyglycoside, some ethoxylated fatty amine was employed to further improve the appearance and solubility of the amide softener. The formulation prepared can be seen from the following.

| | % BY WEIGHT | | | | |
|---|---|---|---|---|---|
| Ingredient | A | 1 | 2 | 3 | 4 |
| (a) hydrogenated tallow (oleic steroic) diethanolamide | 79.0 | 79.0 | 73.0 | 70.0 | 70.0 |
| (b) hexylene glycol | 10.5 | — | — | — | — |
| (c) ethoxylated (30) nonyl phenol | 10.5 | — | — | — | — |
| (d) ethoxylated fatty amine | | | | | |
| 1. Trymeen 6617* | — | — | 1.0 | 5.0 | — |
| 2. Trymeen 6607** | — | — | 5.0 | 5.0 | 5.0 |
| (e) alkylpolyglycoside** (50% active in water) | | 21.0 | 21.0 | 20.0 | 25.0 |

*ethoxylated (50) stearyl amine
**ethoxylated (20) tallow amine
***APG ® 300 - alkylpolyglycoside available from Henkel Corporation in which the alkyl group is a mixture of $C_9$, $C_{10}$, $C_{11}$ chains in a ratio by weight respectively of 20:40:40 having an average DP of 1.4 and an HLB of 12.6.

The mix of appearance of Sample A was a tan soft solid while the others containing the alkylpolyglycoside were amber or honey-brown soft solids (pastes). Upon dilution to 18.5% concentration in water, all the samples were off white in color. Sample A was a viscous thick liquid, while sample 4 was a very thin liquid. Sample 1 was a viscous liquid with some body, but not as viscous as sample A. Samples 2 and 3 were liquid but contained some gel particles.

EXAMPLE 2

Sample formulations A and 4 were prepared to provide 1000 grams of product for evaluation for softening and for scorching. The results were as follows:

| | Sample A | Sample 4 |
|---|---|---|
| Physical Tests: Appearance | | |
| Melt | Clear | Clear |
| Room Temperature | Tan, soft paste | Honey-Brown, soft paste |
| Acid Value* | 4.95 | 4.98 |
| Amine Value** | 31.50 | 30.73 |
| pH, 2% Solution | 9.21 | 8.94 |
| Hand-Softness: 1% padded onto 100% cotton (on weight basis-o.w.b.) | very soft | very soft, softer than Sample A |

*mg KOH equivalent to acid in 1 g of sample.
**mg KOH equivalent to amine in 1 g of sample.

The cotton samples were subjected to a second test by exposure to varying temperatures for 30 seconds. The results were as follows:

| Temperature (° F.) | Sample A | Sample 4 |
|---|---|---|
| 300 | no visible scorching | no visible scorching |
| 350 | no visible scorching | no visible scorching |
| 375 | scorched | scorched* |
| 400 | scorched | scorched* |

*not scorched as badly as sample A

EXAMPLE 3

Diluted samples of A and 4 were prepared with the following compositions by weight.

| Ingredients | 5 | 6 |
|---|---|---|
| Sample A | 18.5% | — |
| Sample 4 | — | 21.4% |
| Water | 81.5% | 71.86% |

Sample 5 at room temperature was an off white viscous gel while Sample 2 was a very thin liquid. The diluted samples were evaluated for viscosity and stability by measuring the viscosity at 25° C. in centipoises (cps) over an extended time period using the Brookfield Model DV II Viscosimeter. The viscosity results were as follows.

| | Average Viscosity (cps) | |
|---|---|---|
| Week | Sample 5 | Sample 6 |
| 0 | 96,453 | 30,790 |
| 1 | 107,467 | 26,627 |
| 2 | 124,033 | 30,043 |
| 3 | 173,100 | 30,527 |
| 4 | 108,300 | 29,573 |
| 5 | 148,433 | 28,863 |
| 6 | 159,100 | 31,810 |

The foregoing examples illustrate the significant decrease in viscosity of the amide softener composition through the use of alkylpolyglycoside and the relative stability over an extended period of time.

What is claimed is:

1. A method of imparting improved hand or softening properties to a textile material, said method comprising applying to said textile material an effective amount of a softener composition comprised of (a) at least one fatty acid amide softener agent of a fatty acid having from about 8 to about 22 carbon atoms; and (b) at least one alkylpolyglycoside wherein the ratio by weight of the amide softener (a) to the alkylpolyglycoside is about 1.7:1 to about 8:1.

2. A method as defined in claim 1 wherein the ratio by weight of (a) to (b) is from about 2.8:1 to about 4:1.

3. A method as defined in claim 1 where the amide softener agent (a) is a fatty acid amide of a fatty acid having from about 8 to about 22 carbon atoms and said alkylpolyglycoside (b) contains from about 8 to 22 carbon atoms in the alkyl group.

4. A method as defined in claim 3 wherein said fatty acid amide is the diethanolamide of a fatty acid having about 18 carbon atoms.

5. A method as defined in claim 4 wherein said fatty acid amide is hydrogenated tallow diethanolamide.

6. A method as defined in claim 2 wherein said alkylpolyglycoside (b) has the formula $ROG_r$ where R is an alkyl group having from about 8 to about 22 carbon atoms; O is oxygen, G is the residue of a reducing saccharide and r is a number of about 1.05 to about 3.

7. A method as defined in claim 6 wherein the amide softener (a) is a fatty acid amide of a fatty acid having from about 8 to about 22 carbon atoms.

8. A method as defined in claim 7 wherein said fatty acid amide is hydrogenated tallow diethanolamide.

9. A softened textile material which has distributed therein on a dry fabric substrate weight basis, from about 0.5 to about 20% by weight of a softener composition comprised of (a) at least one fatty acid amide softener agent of a fatty acid having from about 8 to about 22 carbon atoms; and (b) at least one alkylpolyglycoside wherein the ratio by weight of the amide softener (a) to the alkylpolyglycoside is about 1.7:1 to about 8:1.

10. A softened textile material as defined in claim 9 wherein the ratio by weight of (a) to (b) is from about 2.8:1 to about 4:1.

11. A softened textile material as defined in claim 10, wherein said alkylpolyglycoside (b) has the formula $ROG_r$ where R is an alkyl group having from about 8 to 22 carbon atoms; O is oxygen, G is the residue of a reducing saccharide and r is a number of about 1.05 to about 3.

12. A softened textile material as defined in claim 11 wherein said fatty acid amide is the diethanolamide of a fatty acid having about 18 carbon atoms.

13. A softened textile material as defined in claim 11 wherein said fatty acid amide is hydrogenated tallow diethanolamide.

* * * * *